United States Patent [19]

Cannac et al.

[11] Patent Number: 5,056,959

[45] Date of Patent: Oct. 15, 1991

[54] METHOD AND DEVICE FOR STRIPPING FROM THE CONCRETE TO WHICH IT ADHERES THE HEADER OF A WALL SECTION CAST IN THE GROUND

[75] Inventors: Paul Cannac, Le Bousquet d'Orb; Gérard Geist, Calais, both of France

[73] Assignee: Soletanche, Nanterre, France

[21] Appl. No.: 531,159

[22] Filed: May 31, 1990

[30] Foreign Application Priority Data

Jun. 6, 1989 [FR] France ..... 89 07456

[51] Int. Cl.[5] ..... E02D 9/00

[52] U.S. Cl. ..... 405/267; 405/303; 249/66.1; 425/59; 425/63

[58] Field of Search ..... 405/267, 303; 249/66.1; 264/33; 52/742; 425/59, 63

[56] References Cited

U.S. PATENT DOCUMENTS

| | | | |
|---|---|---|---|
| 1,233,878 | 7/1917 | Horning | 249/66.1 |
| 3,428,287 | 2/1969 | Redding et al. | 425/63 X |
| 3,822,861 | 7/1974 | Scott | 249/66.1 X |
| 3,981,603 | 9/1976 | Sprunger | 425/63 X |
| 4,930,940 | 6/1990 | Charlier et al. | 405/267 |

FOREIGN PATENT DOCUMENTS

| | | | |
|---|---|---|---|
| 1578438 | 8/1979 | France . | |
| 141128 | 4/1980 | German Democratic Rep. | 249/66.1 |
| 42206 | 2/1989 | Japan | 249/66.1 |
| 1-05814 | 4/1989 | Japan | 405/267 |
| 315614 | 10/1971 | U.S.S.R. | 249/66.1 |
| 369233 | 4/1973 | U.S.S.R. | 264/33 |
| 245964 | 1/1926 | United Kingdom | 425/59 |

*Primary Examiner*—Dennis L. Taylor
*Assistant Examiner*—John Ricci
*Attorney, Agent, or Firm*—Schweitzer Cornman & Gross

[57] ABSTRACT

Apparatus for stripping a header from a cast concrete section to which it is adhered adjacent to a site for contiguous concrete section comprising a vertical track in direct association with the header; the track having an opening facing the site; and impact tool adapted to move slidingly within the track to predetermined locations therein; and the impact tool being further adapted to be displaced horizontally within the track to apply a separation force through the track to the header to disrupt adhesion of the header with the concrete.

6 Claims, 1 Drawing Sheet

METHOD AND DEVICE FOR STRIPPING FROM THE CONCRETE TO WHICH IT ADHERES THE HEADER OF A WALL SECTION CAST IN THE GROUND

BACKGROUND OF THE INVENTION

The present invention relates to a method and a device for stripping from the concrete to which it adheres the header of a wall section cast in the ground.

The art of casting a wall in the ground is well known, and consists generally in excavating a trench, placing a header at the end of the trench, pouring concrete into the trench and stripping out the header.

In these processes the trench is generally dug under bentonitic mud. Once the trench has been dug, a header is generally immersed in the mud and placed at the end of the trench. Concrete is then poured to replace the mud, the concrete therefore coming in contact with the header. When the concrete has set, another trench is cut adjacent to the first on the other side of the header, generally using the latter to guide the drilling machine.

The problem that then arises is to remove the header. Actually, the header strongly adheres to the concrete, such that it is necessary to strip it away before removing it. This stripping is generally performed by a lateral displacement with the aid of jacks or wedges. These devices, however, have the disadvantage of being complex and tying up the worksite.

It has also been proposed in document FR-A-2613395 to coat the face of the header with a thin material that can be left in the trench and to extract the header substantially vertically, abandoning the coating material.

Although it is generally satisfactory, the latter method requires the application of very great vertical force to the header.

The present invention aims to provide a new method permitting the elimination of these problems.

SUMMARY OF THE INVENTION

To this end, the invention first of all has as its object a method for stripping from the concrete to which it adheres a header for a wall section cast in the ground, characterized by the fact that a shock is applied to the header from the side opposite the concrete by means of a tool attached to the header at a point situated above the point of impact.

The shock itself has, of course, a favorable effect for the stripping of the header. However, what is essential is the reaction exerted by the tool on the header at the location to which it is attached, this reaction causing the header to be torn away from the concrete to which it adheres.

In the case of a slab of great depth, it is preferable to proceed by successive steps by successively applying a plurality of shocks to the header at points situated at increasing depth in the trench.

The shock can be applied quite simply by using the clamshell bucket of the machine excavating the trench and connecting its upper part to the header. By opening the jaws of the clamshell, the shock is exerted by the jaw of the clamshell that is situated next to the header.

The invention also has as its subject matter a device for the practice of the method described above, characterized by the fact that it has in combination a track formed in the header and a tool equipped with a means adapted to cooperate with the track and a means adapted to apply a shock to the header.

A description will now be given by way of a nonlimiting example of a particular embodiment of the invention in conjunction with the diagrammatic drawings annexed, wherein:

DETAILED DESCRIPTION OF THE INVENTION

Figure 1:
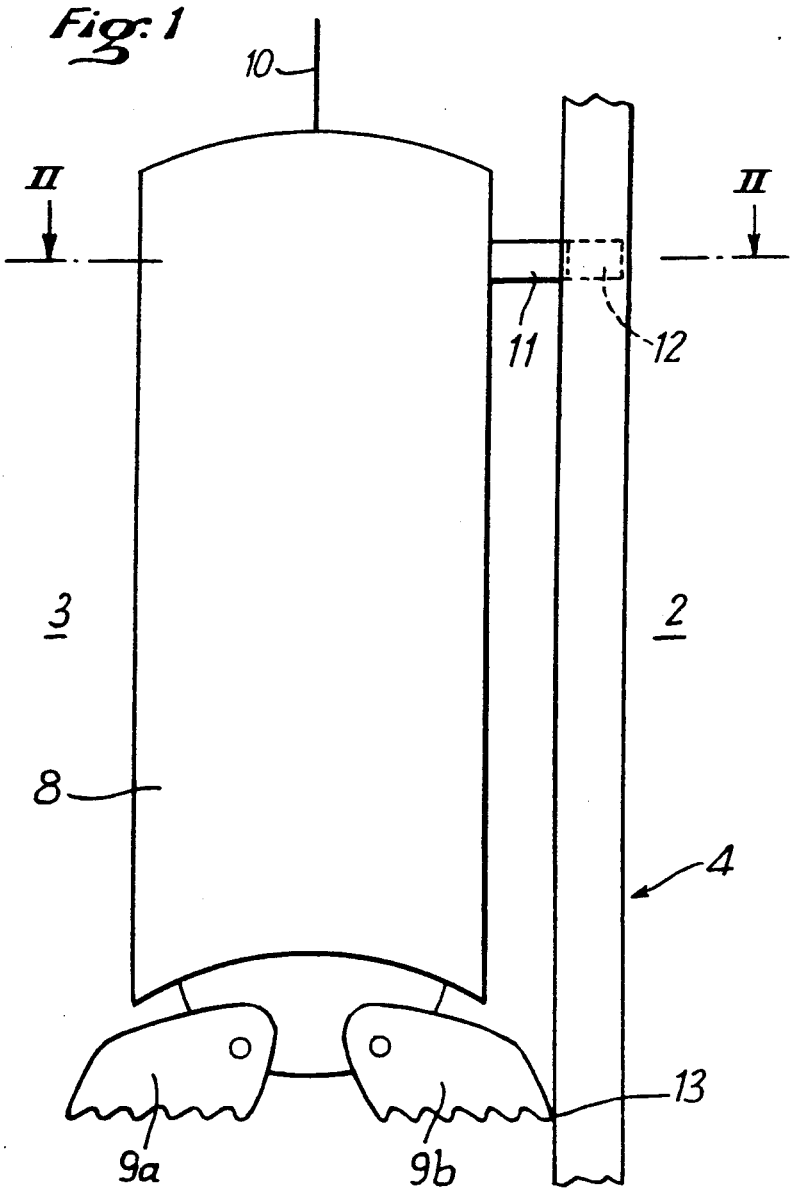
FIG. 1 is an elevational view of a clamshell bucket and of a header of the slab.
Figure 2:
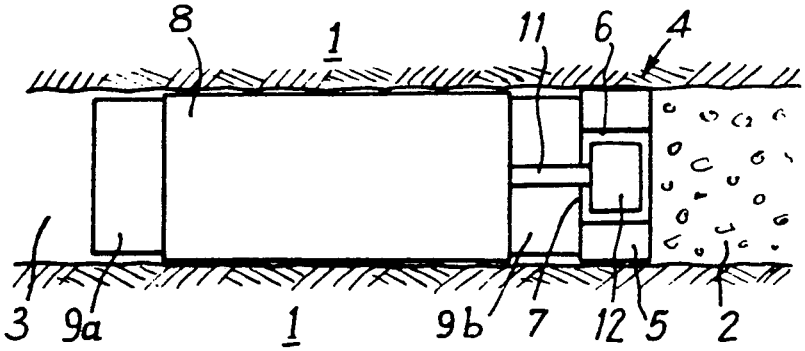
FIG. 2 is a cross sectional view taken along line II—II of FIG. 1.

The drawings represent a wall 1 being cast in the ground, the section 2 having already been poured and section 3 being excavated under bentonitic mud.

A header 4 separates sections 2 and 3 and adheres to the concrete of section 2 from which it has to be stripped.

For this purpose the header 4 is made in the form of a box section 5 in which is formed a track 6 defined by four walls, the wall on the side facing section 3 being provided with a longitudinal slot 7.

An excavator clamshell bucket provided with its jaws 9*a* and 9*b* and its cables 10 has been represented diagrammatically at 8.

At the upper part of the body of the clamshell bucket 8 a retractable rod 11 is mounted on the bucket so as to be able to be in a deployed position represented in the drawings for the stripping of the header 4, or in a retracted position, not shown, when the bucket is used in excavating the trench.

The rod 11 has at its extremity a guidance and reaction arm 12 which can engage in the track 6 with the rod 11 extending out of this track through the slot 7.

when the rod 11 is in its deployed position and the arm 12 is engaged in the track 6, the distance between the bucket 8 and the header 4 is such that, if the jaws 9*a* and 9*b* are opened, jaw 9*b* will strike against the header 4.

If, therefore, in this position the jaws 9*a* and 9*b* are opened, preferably as violently as possible, a shock will be applied at 13 to the header 4.

In reaction, the arm 12 will strike against the slotted side of the track 6 and consequently exert a violent stress upon the header 4 from the side of the bucket, thus causing it to be stripped away from the concrete 2.

Variants and modifications can, of course, be added to the above description without departing either from the scope or from the spirit of the invention.

Thus, if it is desired not to idle the excavating bucket during the header stripping operations, a special tool can be used, cooperating in the same manner with the track at its upper part, and provided at its lower part with any means permitting the application of a shock to the header.

One might also adopt any other shape for the track and the guidance and reaction arm with which it cooperates.

We claim:

1. A method of stripping a header having a surface firmly adhered to a cast concrete section formed in the ground adjacent to the site of a contiguous concrete section to be cast in place comprising the steps of:

(a) providing said header with a track-like opening facing said site and extending vertically, said opening accommodating sliding movement of an impact device therein and limiting horizontal movement of said impact device away from said header;

(b) excavating said site adjacent said header with a heavy movable excavator;

(c) locating an impact device within said track-like opening; and (d) providing an impact force to said impact device to cause said device to strike said header and to tend to disrupt said adhesion of said header to said cast concrete section.

2. The method of claim 1 including the steps of:

(a) applying said impact forces at successive vertical points in said track-like opening.

3. The method of claim 1 further characterized in that:

(a) said heavy excavator is a clamshell bucket excavator having openable jaws;

(b) said jaws are used to excavate said site and to provide said impact force; and (c) said impact device is directly associated with said clamshell bucket.

4. Apparatus for stripping a header from a cast concrete section to which it is adhered adjacent to a site for contiguous concrete section comprising:

(a) vertical track means in direct association with said header;

(b) said track means having an opening facing said site;

(c) impact tool means adapted to move slidingly within said track means to predetermined locations therein; and (d) said impact tool means being further adapted to be displaced horizontally within said track means to apply a separation force through said track means to said header to disrupt adhesion of said header with said concrete.

5. The apparatus of claim 4 which includes:

(a) clamshell bucket means having movable jaws; and (b) said impact tool means is connected to an upper portion of said bucket above said jaws.

6. The apparatus of claim 4 in which:

(a) said track means is disposed within a middle plane of said header.

* * * * *